US006178641B1

(12) United States Patent
Meijer

(10) Patent No.: US 6,178,641 B1
(45) Date of Patent: Jan. 30, 2001

(54) ELECTRICAL HAIR-CUTTING APPARATUS

(75) Inventor: Albert J. Meijer, Drachten (NL)

(73) Assignee: U.S. Philips Corporation, New York, NY (US)

( * ) Notice: Under 35 U.S.C. 154(b), the term of this patent shall be extended for 0 days.

(21) Appl. No.: 09/204,030

(22) Filed: Dec. 1, 1998

(30) Foreign Application Priority Data

Dec. 3, 1997 (EP) ..... 97203790

(51) Int. Cl.[7] ..... B26B 19/10
(52) U.S. Cl. ..... 30/43.92; 30/346.51
(58) Field of Search ..... 30/43.92, 43.91, 30/34.3, 43.6

(56) References Cited

U.S. PATENT DOCUMENTS 4,003,130 * 1/1977 Rookus ..... 30/34.2
4,635,360 * 1/1987 Tanahashi et al. ..... 30/34.2
5,669,138 * 9/1997 Wetzel ..... 30/43.92
5,802,721 * 9/1998 Wain et al. ..... 30/34.2
5,802,932 * 9/1998 Vankov et al. ..... 30/43.92 X
5,893,211 * 4/1999 Hotani ..... 30/43.92

FOREIGN PATENT DOCUMENTS 62-246396 10/1987 (JP) .

* cited by examiner

*Primary Examiner*—M. Rachuba
(74) *Attorney, Agent, or Firm*—Ernestine C. Bartlett

(57) ABSTRACT

A hair-cutting apparatus is provided which has an external cutting member (1) and an internal cutting member (7) which is drivable relative to the external cutting member. The external cutting member has lamellae (3) between which hair-entry apertures (4) are formed, and the ends of the lamellae form teeth (9) for raising hairs before the hairs are cut. To increase the efficiency of hair catching the teeth are given different lengths. Preferably, there are long teeth ($9^a$, $9^b$) and short teeth ($9^1$, $9^2$) which alternate with one another.

2 Claims, 4 Drawing Sheets

ELECTRICAL HAIR-CUTTING APPARATUS

FIELD OF THE INVENTION

The invention relates to an electrical hair-cutting apparatus having an external cutting member and an internal cutting apparatus which is drivable relative to the external cutting member, which external cutting member is formed by a first wall portion, which constitutes a cutting face, and at least a second wall portion, which is disposed at an angle with respect to the first wall portion, which first wall portion has lamellae between which elongate hair-entry apertures are situated, ends of the lamellae extending beyond the second wall portion in such a manner that the ends of the lamellae form a row of teeth for raising hairs before they are severed by cooperation between the cutting members.

BACKGROUND OF THE INVENTION

A hair-cutting apparatus of the type defined in the opening paragraph is known from JP-A-62/246396. The teeth at the ends of the lamellae serve to facilitate the entry of hairs to be severed into the hair-entry apertures between the lamellae. In practice, it appears that partly the hairs are not caught between the teeth but are flattened and, as result of this, do not enter into the hair-entry apertures.

SUMMARY OF THE INVENTION

It is an object of the invention to improve the hair-catching efficiency of the hair-cutting apparatus of the type defined in the opening paragraph. To this end, the hair-cutting apparatus in accordance with the invention is characterized in that the teeth have different projecting lengths with respect to the second wall portion. Surprisingly, it has been found that this results in more hairs being caught per cutting movement, i.e. during an average length of movement of the cutting apparatus over the skin. This can be explained from the fact that the distance between two teeth having a great projecting length (long teeth) is now larger, as a result of which hairs which lie flatter on the skin can be raised. Once such a hair has been lifted this hair can subsequently be raised further and guided into a hair-entry aperture (gap) by a tooth having a smaller projecting length (short tooth). If all the teeth would have the same length such a hair, which lies comparatively flat, could not be raised but would be flattened under the tooth. If in a situation that all the teeth have the same length the distance between the teeth would be made, for example, two or three times as large, this essentially leads to an increased chance of more flat-lying hairs being raised. However, to sever hairs the width of the hair-entry aperture (gap) between the lamellae should be within given limits. This width cannot be chosen to be, for example, twice as large in view of the protrusion of the skin in the hair-entry aperture. Increasing the distance between the teeth would then be possible only, for example, by leaving out every second tooth. In that case there are lamellae whose ends do not terminate in a tooth but which end near the second wall portion. As a result of this, a hair raised by a tooth is not guided properly into the hair-entry aperture because this hair strikes against the second wall portion near the lamella without a tooth and is subsequently flattened underneath the lamellae. It is therefore desirable that at least most lamellae, preferably all lamellae, end in a tooth. By using both long and short teeth, for example alternately, the likelihood of catching is increased and, as a result, the cutting performance is improved.

BRIEF DESCRIPTION OF THE DRAWINGS

The invention will now be described in more detail with reference to an example of a hair-cutting apparatus shown in the drawings, in which only the cutting section is shown. In the drawings.

DETAILED DESCRIPTION OF THE PREFERRED EMBODIMENTS

Figure 1:
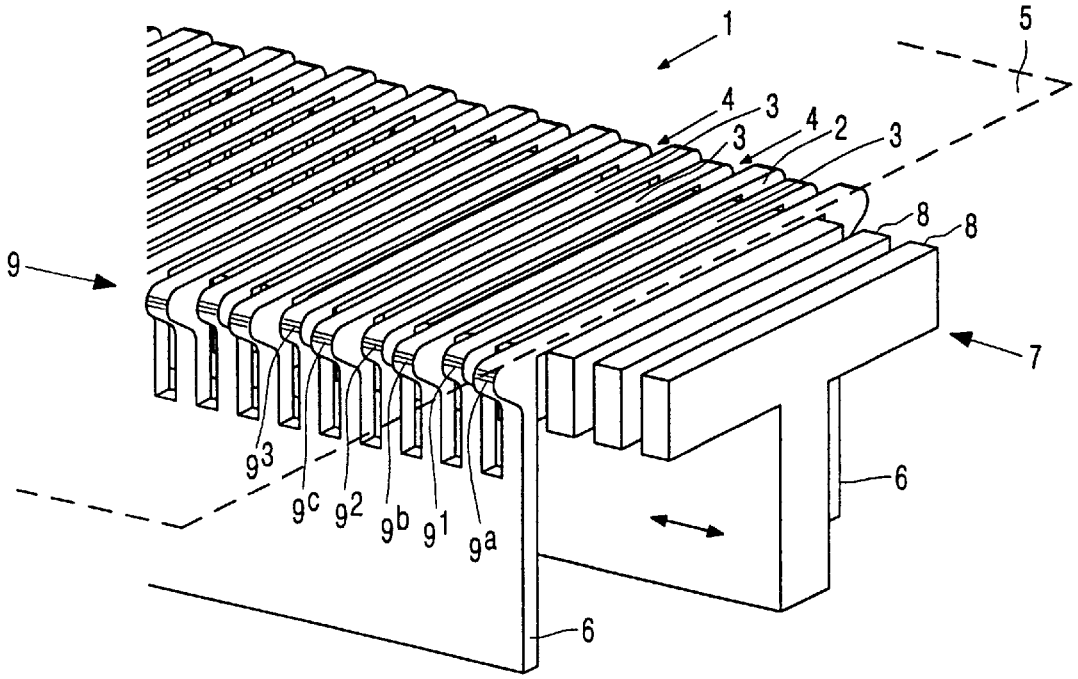
FIG. 1 is a diagrammatic perspective view of a double-action cutting apparatus in accordance with the invention.

The cutting section 1 of a hair-cutting apparatus shown in FIG. 1 has a U-shaped external cutting member 1 comprising a first wall portion 2 with a plurality of lamellae 3 between which elongate hair-entry apertures 4 are formed. The upper surface of this wall portion 2 forms the cutting face 5, which is in contact with the skin during shaving. At opposite sides of the wall portion 2 the cutting member 1 has a second wall portion 6 which is disposed at an angle relative to the first wall portion 2 and in the present example is disposed at a right angle to this first wall portion. However, alternatively this angle may be an oblique angle. The internal cutting member 7 comprises cutting elements 8. In known manner, the cutting member 7 is driven so as to reciprocate. As a result of the cooperation between the cutting elements 8 and the lamellae 3 hairs caught in the hair-entry apertures 4 (gaps) are severed. The ends of the lamellae 3 extend beyond the second wall portion 6 in such a manner that these projecting ends form rows 9 of teeth. In the example shown in FIG. 1 a row of teeth has two types of teeth, namely long teeth $\mathbf{9}^a$, $\mathbf{9}^b$, . . . and short teeth $\mathbf{9}^1$, $\mathbf{9}^2$, . . . disposed in an alternating arrangement. The long teeth project, for example, 0.8 mm and the short teeth approximately 0.4 mm beyond the second wall portion 6. However, it is obviously also possible to have, for example, one short tooth after every two teeth, or the other way round.

Figure 2:
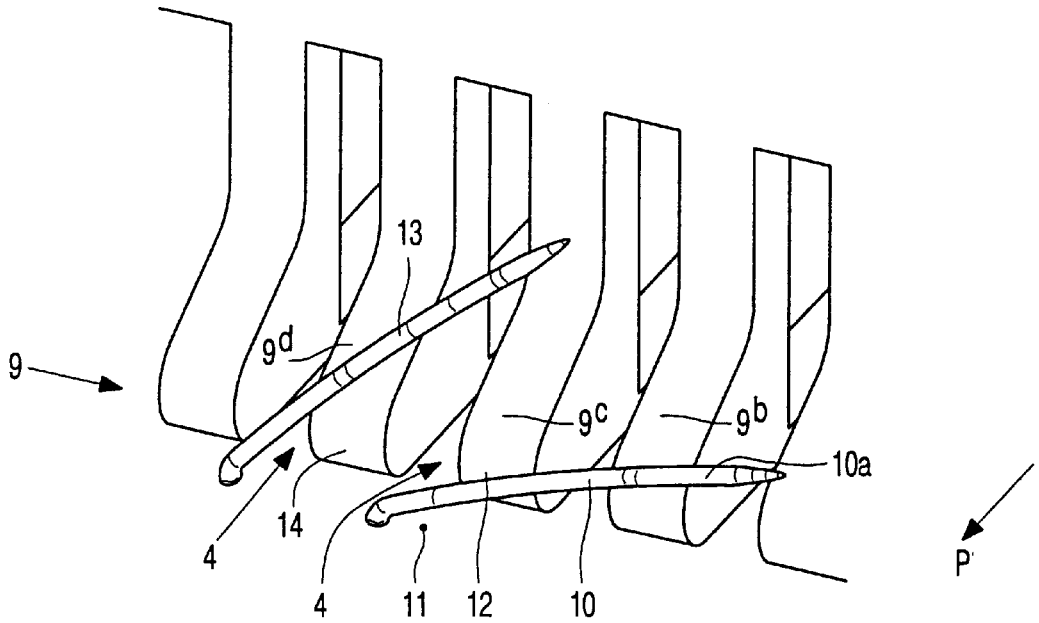
FIG. 2 is a detailed view of a prior-art cutting apparatus whose teeth all have the same projecting length.

It will now be explained first why in a cutting apparatus having both long and short teeth has can be raised and guided into the hair-entry apertures in a better way than a cutting apparatus having teeth which all have the same length. FIG. 2 shows a detail of the teeth of a prior-art hair-cutting apparatus, in which for the sake of clarity the teeth are shown upside down in, comparison with FIG. 1. An arrow P indicates the direction of movement of the hair-cutting apparatus over the skin. The teeth 9 all have the same length. A hair to be severed 10 lies comparatively flat on the skin 11. As the hair-cutting apparatus is moved over the skin the tip 12 of the tooth $\mathbf{9}^c$ comes into contact with the hair. A tooth tip is always rounded. Since the hair lies comparatively flat the hair will slip underneath the tooth $\mathbf{9}^c$ rather than enter the hair-entry aperture 4. Although towards its end 10*a* the hair 10 is disposed farther from the skin and could be raised by the tooth $\mathbf{9}^b$, this does not happen because the hair has already been pressed downward by the tooth $\mathbf{9}^c$. Only when a hair 13 is in a more erect position can the tip 14 of the tooth $\mathbf{9}^d$ slip underneath the hair, subsequently lift the hair and guide it into the hair-entry aperture 4.

Figure 3:
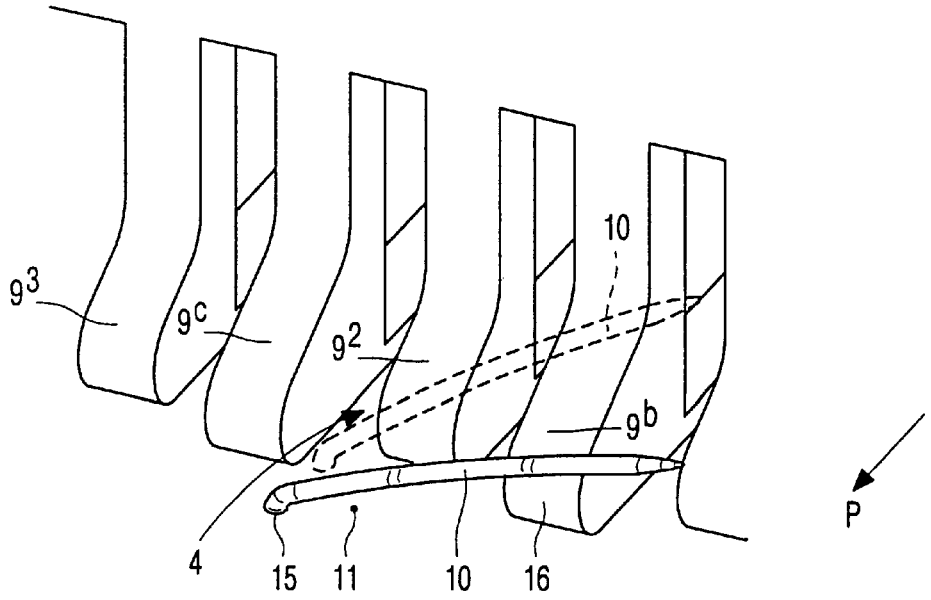
FIG. 3 shows the cutting apparatus of FIG. 1 in a detailed view similar to that of FIG. 2.

FIG. 3 show a situation similar to that in FIG. 2 but now there are long teeth $\mathbf{9}^a$, $\mathbf{9}^b$, . . . and short teeth $\mathbf{9}^1$, $\mathbf{9}^2$ . . .

arranged alternately as in accordance with the invention. FIG. 3, similarly to FIG. 2, shows a hair 10 which lies comparatively flat. Since the short tooth $9^2$ is more receded the hair does not first come into contact with the short tooth $9^2$ but with the adjacent long tooth $9^b$. Since the tooth $9^b$ is farther away from the root 15 of the hair 10 (the hair is slightly inclined), the distance from the hair to the skin at the location of the tooth $9^b$ is larger, as a result of which the tip 16 of the tooth $9^b$ can now slip underneath the hair and can raise this hair. Slightly later the short tooth $9^2$ ensures that the hair is further raised (as indicated in broken lines) and subsequently guides it into the hair-entry aperture 4. It has been found that in this way more hairs are severed per unit of time. This improves the cutting performance and hence the cutting efficiency.

Figure 4:
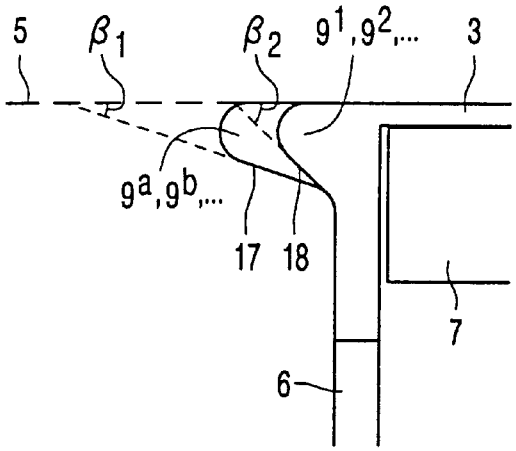
FIG. 4 is a longitudinal sectional view of a tooth in a first embodiment.
Figure 5:
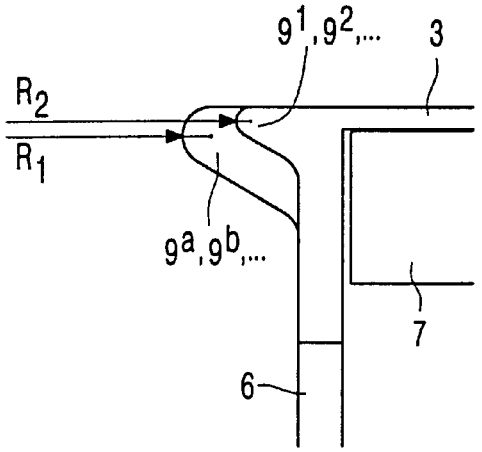
FIG. 5 is a longitudinal sectional view of the tooth in a second embodiment.

The efficiency can be improved even further by choosing the correct apex angle for the teeth, i.e. the angle $\beta_1$ between the cutting face 5 and the wall portion 17 of the tooth $9^a$, $9^b$, . . . and the angle $\beta_2$ between the cutting face 5 and the wall portion 18 of the tooth $9^1$, $9^2$, . . . (FIG. 4). On the one hand, sharp-pointed tooth tips will more readily slip underneath the hairs than less sharp tooth tips but, on the other hand, sharp tooth tips are more likely to irritate the skin than less sharp teeth. A greater number of sharp teeth also give rise to more irritation. Therefore, as is shown in FIG. 5, said apex angle $\beta_1$ for a long tooth $9^a$, $9^b$, . . . is smaller than the apex angle $\beta_2$ for a short tooth $9^1$, $9^2$, . . . The angle $\beta_2$ for the short teeth can be larger because the short teeth serve for further raised the hairs already raised.

The rounding of a tooth tip also influences the irritating effect of the teeth on the skin (FIG. 5). A smaller radius of rounding is more likely to lead to irritation than a large radius. However, a tooth having a smaller rounding can more easily slip underneath a hair. Preferably, the radius $R_2$ of rounding of the short teeth $9^1$, $9^2$, . . . is smaller than the radius $R_1$ of rounding of the long teeth $9^a$, $9^b$, . . . An irritating effect of short teeth is small because the skin which passes underneath the short tooth has already been pressed away slightly by the long teeth.

Figure 6:
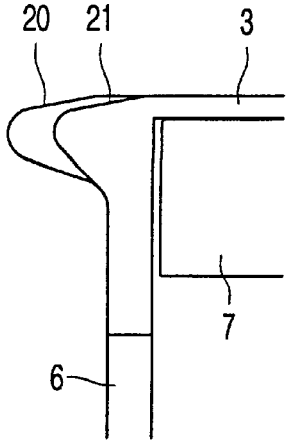
FIG. 6 is a longitudinal sectional view of the tooth in a third embodiment.

In order to minimize an irritating effect during shaving the ends 20, 21 of the teeth are slightly beveled (FIG. 6).

Obviously, the invention can also be applied to a hair-cutting apparatus having a row of teeth at only one side, as is customary in a shaver having a slide-out or swing-out trimmer at one side.

Figure 7:
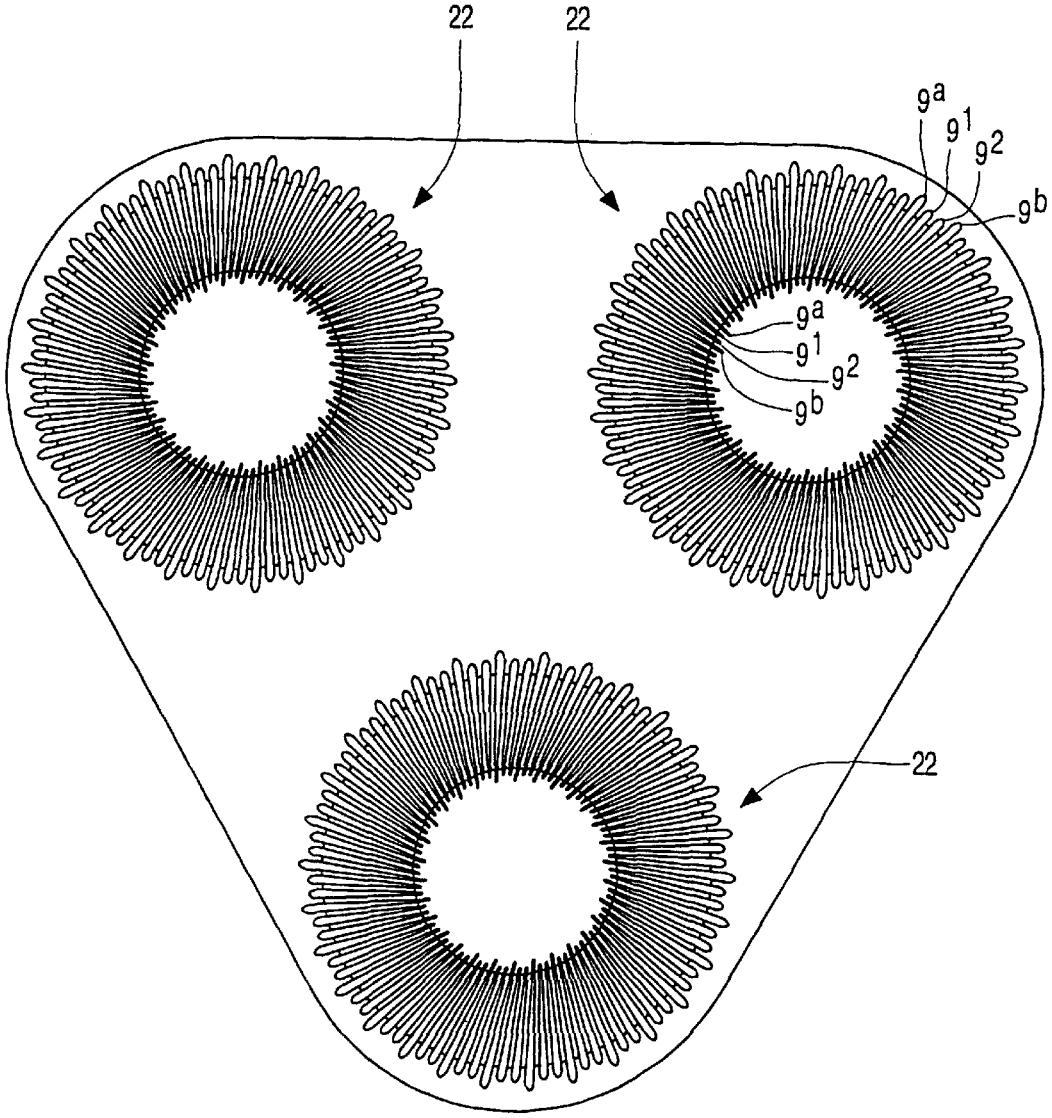
FIG. 7 is a plan view of a hair-cutting apparatus constructed as a triple-head shaver having circular shaving heads.

FIG. 7 shows another example of a hair-cutting apparatus in the form of a triple-head rotary shaver having circular shaving heads 22. The lamellae 3 with the hair-entry apertures between them are oriented in substantially radial directions. All the ends of the lamellae form teeth having different projecting lengths. In the present example two short teeth $9^1$, $9^2$ are disposed between two long teeth $9^a$, $9^b$.

What is claimed is:

1. A cutting apparatus having an external cutting member and an internal cutting member which is drivable relative to the external cutting member, which external cutting member is formed by a first wall portion, which constitutes a cutting face, and at least a second wall portion, which is disposed at an angle with respect to the first wall portion, which first wall portion has lamellae between which elongate hair-entry apertures are situated, ends of the lamellae extending beyond the second wall portion in such a manner that the ends of the lamellae form a row of teeth for raising hairs to be severed between the cutting members, wherein the teeth have different projecting lengths with respect to the second wall portion and comprise a first type of teeth and a second type of teeth, the first type of teeth being long teeth having a larger projecting length when compared to the second type of teeth, and wherein, viewed in a longitudinal section of a lamella, an apex angle of a tooth of the first type is smaller than an apex angle of a tooth of the second type.

2. A cutting apparatus having an external cutting member and an internal cutting member which is drivable relative to the external cutting member, which external cutting member is formed by a first wall portion, which constitutes a cutting face, and at least a second wall portion, which is disposed at an angle with respect to the first wall portion, which first wall portion has lamellae between which elongate hair-entry apertures are situated, ends of the lamellae extending beyond the second wall portion in such a manner that the ends of the lamellae form a row of teeth for raising hairs to be severed between the cutting members, wherein the teeth have different projecting lengths with respect to the second wall portion and comprise a first type of teeth and a second type of teeth, the first type of teeth being long teeth having a larger projecting length when compared to the second type of teeth, and wherein viewed in a longitudinal section of a lamella, the tooth tips of the teeth of the second type have a smaller radius of rounding than the tooth tips of the teeth of the first type.

* * * * *